United States Patent [19]

Diaz

[11] Patent Number: 5,040,249

[45] Date of Patent: Aug. 20, 1991

[54] PORTABLE, COLLAPSIBLE COMMODE

[76] Inventor: Richard Diaz, 6295 Baldridge Canyon Dr., Highland, Calif. 92346

[21] Appl. No.: 500,586

[22] Filed: Mar. 28, 1990

[51] Int. Cl.[5] ..... A47K 11/06

[52] U.S. Cl. ..... 4/484; 4/460; 4/479; 4/DIG. 9

[58] Field of Search ..... 4/459, 460, 464, 476, 4/478, 479, 483, 484, DIG. 9

[56] References Cited

U.S. PATENT DOCUMENTS

| | | | |
|---|---|---|---|
| 1,947,940 | 2/1934 | Isom | 4/478 |
| 2,685,399 | 8/1954 | Crosby | 4/484 X |
| 2,849,726 | 9/1958 | Vay | 4/484 X |
| 2,893,017 | 7/1959 | Beck | 4/484 X |
| 2,912,702 | 11/1959 | Mackenzie | 4/484 X |
| 2,974,321 | 3/1961 | Salka | 4/484 X |
| 3,118,146 | 1/1964 | Dorey | 4/476 |
| 3,142,847 | 8/1964 | Kurrels | 4/484 |
| 3,159,848 | 12/1964 | Arndt, Jr. | 4/476 |
| 3,451,453 | 6/1969 | Heck | 206/390 |
| 3,484,875 | 12/1969 | Eisenberg | 4/484 |
| 3,579,655 | 5/1971 | Sundberg | 4/476 |
| 3,600,719 | 8/1971 | Karr | 4/484 X |
| 3,772,712 | 11/1973 | Renn et al. | 4/484 |
| 3,863,276 | 2/1975 | Agnew et al. | 4/476 X |
| 4,199,826 | 4/1980 | Devereux | 4/479 |

FOREIGN PATENT DOCUMENTS

| | | | |
|---|---|---|---|
| 0528453 | 10/1940 | United Kingdom | 4/460 |

*Primary Examiner*—Henry J. Recla
*Assistant Examiner*—Casey Jacyna
*Attorney, Agent, or Firm*—Milton S. Gerstein

[57] ABSTRACT

A portable, collapsible toilet with a central, main section of box-like construction, which is made of corrugated cardboard, which central section is open both on the top and bottom, and accepts therein a disposable, plastic bag which receives the human waste products. The central section is flanked on either side thereof by a small, box-like supportive end-section upon which one directly sits during use of the commode. Each box-like end-section is also made of corrugated cardboard, is open on the top and bottom, and has an intermediate stiffening member to enhance its structural integrity, in order to support greater weight thereon. The central section is provided with a pair of pivotal cover-members formed integrally with the upper edge surfaces of the central section. Each cover-member is a flat sheet of cardboard, and pivotally connected to a respective upper edge surface of the central section, so that during storage of the commode, each cover-member is in its downwardly-pivoted state within the interior of the central section. In the erected state of the commode, each cover-member is pivoted up and out of the central section's interior, and pivoted until it closes off the open top of a respective box-like end-section, whereby the two cover-members thus provide a pair of spaced-apart seat-surfaces upon which one may sit during use.

19 Claims, 1 Drawing Sheet

FIG. 1
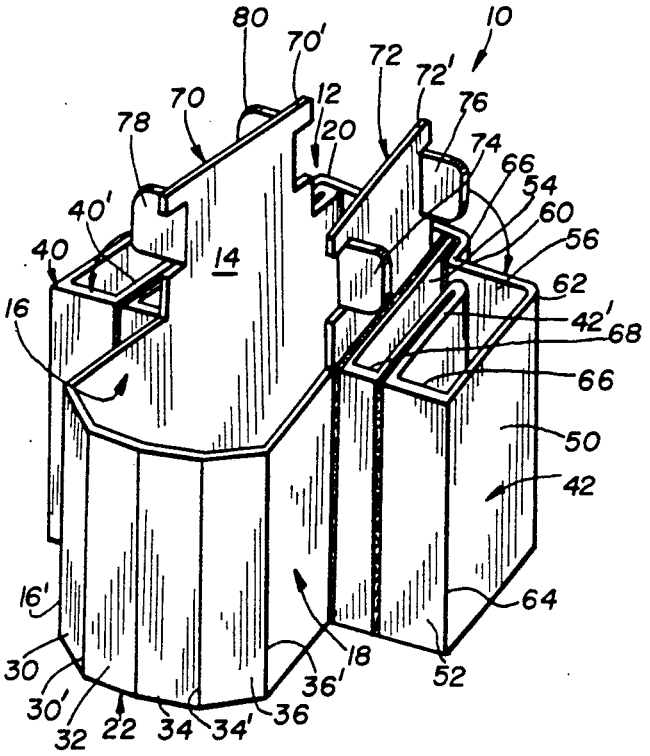
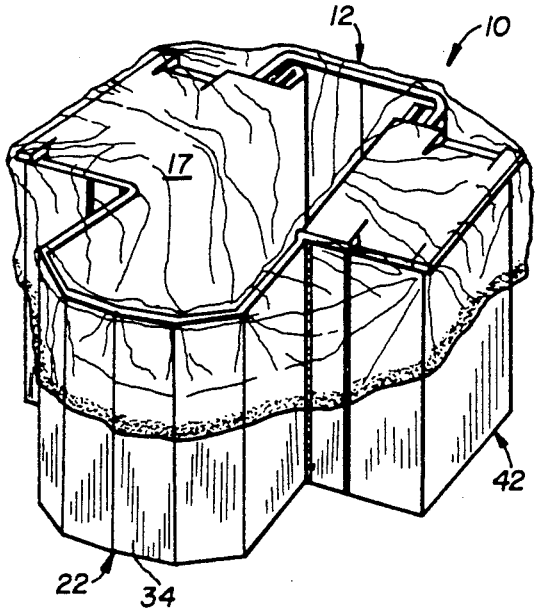
FIG. 2
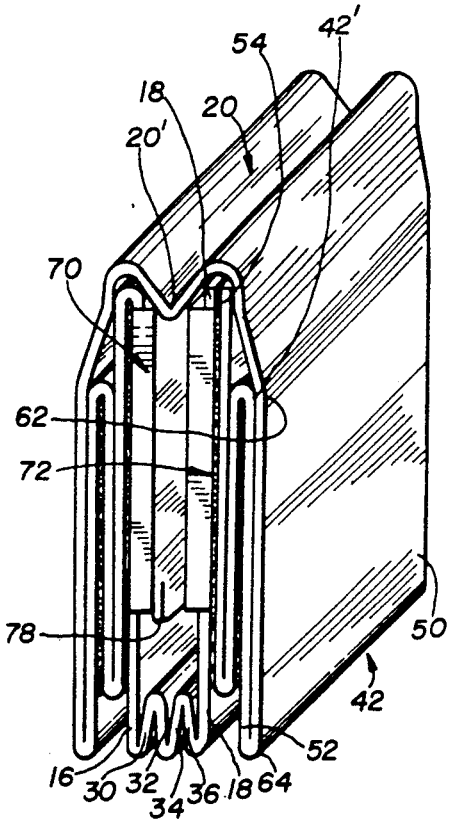
FIG. 3

PORTABLE, COLLAPSIBLE COMMODE

BACKGROUND OF THE INVENTION

The present invention is directed to a portable commode, or dry toilet, which may be used outdoors or any place where access to conventional water closets, or toilets, is not possible. The portable commode of the invention is intended for use while one is camping, hiking, boating, and the like, as well as for use by toddlers, in order to help toilet-train them, and for use by invalids. The invention also has especial intended use in major disaster situations, such as after an earthquake or flood. Lack of sanitary conditions, including lack of proper human-waste disposal, has, in past disasters, led to serious outbreaks of disease. The portable and easily erectable dry toilet of the invention is ideally suited to help prevent such outbreaks.

Prior-art portable commodes exist, such as those shown in U.S. Pat. No. 3,484,875—Eisenberg and U.S. Pat. No. 3,579,655—Sundberg. Prior-art portable toilets, however, are relatively cumbersome to use, are relatively difficult to collapse and erect, are uncomfortable to use, are costly to make, and are generally not made as a disposable item. The present invention overcomes all of these above-noted deficiencies by providing a portable and collapsible commode that is made of corrugated cardboard, or its equivalent, which is readily and easily folded into its collapsed state or unfolded into its ready-to-use state, erected, state. The commode of the invention is provided with sufficient structural integrity so as to support directly thereon a man of over 300 pounds, in a manner that is safe, secure and comfortable. The commode of the invention is used in a similar manner as to that of conventional, fixed-water-closets, in that the commode of the invention directly supports the person thereon in a firm and safe manner while using the commode.

SUMMARY OF THE INVENTION

It is, therefore, the primary objective of the present invention to provide a portable, collapsible toilet made of corrugated cardboard, or the like, which is collapsed by folding it up along fold lines, and erected by unfolding it along the fold lines.

It is another objective of the invention to provide a portable, collapsible toilet that firmly and safely supports directly a person seated thereon during defecation.

It is yet another objective of the invention to allow for a personal commode that is disposable after one use, owing to the reduced costs associated with the material from which the commode is made.

It is still another objective of the invention to provide such a portable, collapsible commode that, when collapsed, is very light weight, and which is easily transported by inserting it into a relatively small bag or case, for disposing of the commode, if desired, or for the eventual reuse thereof.

It is also an objective of the invention to allow for reuse of the commode of the invention by providing plastic, disposable bags, each of which is insertable into the commode of the invention, and in which waste products are contained for subsequent disposal, which bags prevent the commode proper from coming into contact with any waste products.

Toward these and other ends, the portable, collapsible toilet of the invention is provided with a central, main section of box-like construction, which is made of corrugated cardboard, which central section is open both on the top and bottom, and accepts therein a disposable, plastic bag which receives the human waste products. The central section is flanked on either side thereof by a small, box-like supportive end-section upon which one directly sits during use of the commode. Each box-like end-section is also made of corrugated cardboard, is open on the top and bottom, and has an intermediate stiffening member to enhance its structural integrity, in order to support greater weight thereon. The central section is provided with a pair of pivotal cover-members formed integrally with the upper edge surfaces of the central section. Each cover-member is a flat sheet of cardboard, and pivotally connected to a respective upper edge surface of the central section, so that during storage of the commode, each cover-member is in its downwardly-pivoted state within the interior of the central section. In the erected state of the commode, each cover-member is pivoted up and out of the central section's interior, and pivoted until its closes off the open top of a respective box-like end-section, whereby the two cover-members thus provide a pair of spaced-apart seat-surfaces upon which one may sit during defecation. Each cover-member also has a pair of spaced-apart retaining flaps which snugly fit inside the interior portion of the respective end-section, which interior portion is located exteriorly of the intermediate stiffening member, in a direction away from the central box-like section. The cover-members serve to disperse the weight of a person over the entire end-sections, whereby even greater load-carrying capacity is achieved, so that a man of over 300 pounds may be readily and safely supported thereon.

BRIEF DESCRIPTION OF THE DRAWINGS

The invention will be more readily understood with reference to the accompanying drawing, wherein:

FIG. 1 is an isometric view showing the portable, collapsible toilet of the invention in its partially-erected state;

FIG. 2 is an isometric view of the portable, collapsible toilet of the invention in its fully-erected state, with a disposable plastic bag inserted therein for catching and storing waste products; and FIG. 3 is an isometric top view of the portable collapsible toilet of the invention in its collapsed state achieved via the fold-lines thereof.

DETAILED DESCRIPTION OF THE INVENTION

Referring now to the drawing in greater detail, the portable, collapsible dry toilet of the invention is indicated generally by reference numeral 10. The dry toilet or commode 10 is preferably made of recycled corrugated cardboard, or its equivalent. The commode 10 appears like a toilet, and is so formed so as to allow a person to be seated thereon during the process of relieving oneself. The commode 10 is readily and easily collapsible and erectable, and fold and unfolds along fold-lines described below. There is provided a central, box-like, primary section 12 which defines a waste-receiving interior chamber 14. In the preferred use of the invention, the chamber 14 receives a disposable, plastic bag or liner 17, seen in FIG. 2, so that the commode proper does not come in contact with the waste products, so that the commode 10 may be reused a number of times.

The central section 12 is open on the top and bottom and is delimited by a pair of side walls 16, 18, a rear wall 20, and a front wall 22. The pair of side walls 16, 18 are straight sections , without any fold-lines, while each of the front and rear walls 20, 22 are multi-sectioned members, with the rear wall having one vertically-oriented, central fold-line 20', and with the front wall being made of four separate sections 30, 32, 34, 36, which are formed via fold-lines 30', 32', 34', to form a slightly, outwardly-bowed formation. Two additional fold-lines 16' and 36' are provided where the two end sections 30 and 36 are connected to the forward edge surfaces of the side walls 16, 18, respectively. Thus, the forward wall is collapsible by folding inwardly along these fold-lines, into a collapsed state shown in FIG. 3, which collapsed state is used for packaging and transporting the product, as well as for disposing of the product after use, or for subsequent reuse when a plastic insert-bag is used, as shown in FIG. 2. The central section 12 is flanked on either side by similar, shorter-length, supporting, box-like end-sections 40 and 42. Each end-section 40, 42 is the mirror-image of the other, so only the end-section 42 shall be described, it being understood that the end-section 40 is identically configured. Each end-section has a height the same as that of the central box-like section 12, and defines an inner volume divided by a stiffener-member 40', 42', each stiffener-member actually being a double-layer of cardboard with the two layers thereof being glued, or otherwise permanently secured, to each other. Each end-section has an exterior side wall 50, a front wall 52, and interior side wall 54, and a rear wall 56. Each interior side wall 54 is glued, or adhesively secured, to the exterior surface of a respective side wall 16, 18, along the entire length thereof, as seen in FIG. 1. Each stiffener-member projects from the mid-point of the interior of the respective front wall rearwardly therefrom, a distance close to, but spaced from the interior of the respective rear wall 56, owing to the one-piece construction of the product. However, clearly, the stiffener-member may project and contact the interior of the rear surface and be bonded thereto. Each stiffener-member divides its respective interior into two portions: An interior volume directly juxtapositioned and bounded by a respective interior side wall 54, and an exterior volume bounded by a respective exterior side wall 50. Owing to the fact that the entire product may be made from one single piece of corrugated cardboard, the rear walls 56 of the end-sections and the rear wall 20 of the central section are one continuous surface, so that there is formed a step-portion 66 on either side of the central section which is bonded to the respective rear exterior surface of a side wall 16, 18, as clearly shown in FIG. 1, by which structural integrity is achieved, and which allows for the formation of the end-sections 40, 42 from the one piece of cardboard. Of course, the three sections may be made from different pieces of cardboard and appropriately bonded together to form one integral unit 10. Each of the end-sections 40, 42 is also open on the top and bottom, and collapse, or folds up, along vertical fold-lines 60, 62, 64, 66 and 68, so that the collapsed or folded-up unit appears as that shown in FIG. 3, which collapsed state has an overall width approximately one-fifth as that of the erected box shown in FIG. 1, which width is measured from one end-section toward the other end-section.

The end-sections 40, 42 are used for actually supporting the buttocks area of a person using the product 10. Thus, each section 40, 42 serves as a support or seat. This is accomplished by the provision of a pair of oppositely-disposed, pivotal seat-support flaps 70, 72, projecting upwardly from the upper edge surfaces of the side walls 16, 18, respectively, in the manner clearly shown in FIG. 1. Each seat-support flap 70, 72 has a width, as measured from its joinder to the upper edge surface of the respective side wall 16, 18 to its free longitudinal edge surface 70', 72', respectively, that is approximately equal to the width of the respective end-section 40, 42, so that when the flaps are pivoted outwardly in the direction of the arrows shown in FIG. 1, the open tops of the end-sections 40, 42 will be closed off, so as to provide a support surface for the seated buttocks, with the central chamber 14 receiving the waste products during defecation. In order to firmly, yet releasably, hold the seat-support flaps 70, 72 in the horizontal position on the end-sections, there are provided a pair of longitudinally-spaced apart holding tabs 74, 76 for the flap 72, and tabs 78, 80 for the flap 70. Each holding tab has a lateral extent, or width, only slightly less than the width of the exterior volume of each end-section, so that the tabs may be received and retained in a respective exterior volume, for not only retaining the respective flap in its horizontal position, but also for reinforcing the end-sections by the additional cross-supports provided between the exterior side wall 50 and the stiffener-member 40' or 42', created when the tabs are forced downwardly and partially into the exterior volume of the respective end-section. In the collapsed or folded-up state of the commode 10, the flaps 70, 72 are pivoted into the interior chamber 14 of the central section, and pressed against the respective interior surfaces of the side walls 16, 18 during storage, with the holding tabs also being appropriately pivoted to a more planar relationship with the remainder of the respective flap 70, 72.

As mentioned above, when the commode is to be reused, biodegradable plastic liner-bags 16 are used for receiving the waste products, along with biodegradable wipes. Each bag preferably has a strip of covered-over adhesive strip, with the protective cover thereof being removed after using the commode, so as to expose the adhesive strips, with this cover being tossed into bag, after which the adhesive strip is then utilized for sealing the mouth of the bag to seal the contents, after which the entire bag with contents is disposed of. The adhesive strip with protective cover is provided on the interior of the upper opening or mouth of the bag, along at least part of the inner circumference thereof, or the entire circumference thereof. In the preferred embodiment, each bag is of sufficient size so as to define an upper rim or mouth that may be wrapped or draped about the entire width and length of the commode, as shown in FIG. 2, so that the bag is held firmly in place, and, just as importantly, so that the clean layer of plastic intervenes between contact of the body with the commode, since the seat-support flaps will thus be covered over. Also, preferably, the entire commode is made from one single sheet of corrugated cardboard having a size of 95 by 13½ inches, with fold-lines and score-lines appropriates provided, it being understood that such would be obvious to one of ordinary skill in the art, the fold-lines allowing for the collapse and unfolding of the commode in accordion-like fashion, as described above. Preferably, the commode is made from recycled, water-resistant, corrugated cardboard "B" Flute/200 lb. test strength. The structural adhesive used is hot glue melt or spray, which is nontoxic, water resistant and having a low-melt temperature. The preferred size is 10×10×12 inches in the erected state, which collapses to 10×10×2 inches. The central section's rear wall may also be provided with a carrying handle.

While a specific embodiment of the invention has been shown and described, it is to be understood that numerous changes and modifications may be made therein without departing from the scope, spirit and intent of the invention as set forth in the appended claims.

What I claim is:

1. A portable commode comprising:

a central section having a hollow interior volume, an open top, a first side wall, a second side wall, a front wall, and a rear wall;

a first supporting end-section juxtapositioned adjacent to said first side wall and extending laterally outwardly therefrom, said first end-section having an exterior side wall, a front wall, a rear wall, and open top;

a second supporting end-section juxtapositioned adjacent to said second side wall and extending laterally outwardly therefrom, said second end-section having an exterior side wall, a front wall, a rear wall, and an open top;

first means for closing off said open top of said first end-section; and second means for closing off said open top of said second end-section;

said first and second means for closing off being capable of supporting a seated person during the process of relieving oneself;

each of said central section and said first and second end-sections comprising fold-lines for folding said sections, for collapsing the commode.

2. The commode according to claim 1, wherein each of said central section and said first and second end-sections are open on the bottom.

3. The commode according to claim 1, wherein said front wall and said rear wall of said central section comprises at least one vertical fold-line.

4. The commode according to claim 3, wherein said front wall of said central section comprises three foldable sections divided by fold-lines.

5. The commode according to claim 4, wherein each of said first and second end-sections defines a hollow interior volume, and a reinforcing member within said hollow interior volume, whereby said interior volume is divided thereby into a laterally interior volume closer to said central section, and a laterally exterior volume farther away from said central section.

6. The commode according to claim 5, wherein each of said first and second means for closing off comprises a pivotal flap portion having an upper longitudinal edge surface, a lower longitudinal edge surface connected to the upper edge surface of one respective said side wall of said central section via a fold-line for pivotal rotation relative thereto; each said flap-portion being rotatable downwardly toward a respective said first and second end-section for closing off the open top thereof.

7. The commode according to claim 6, wherein each said pivotal flap-portion comprises at least one retaining tab means for insertion into the hollow interior volume of a respective said first and second end-section for retaining the respective said flap-portion in its state that closes off the open top of the respective said end-section.

8. The commode according to claim 7, wherein each said flap-portion comprises a pair of said spaced-apart tab means, each said tab means being pivotally connected to a portion of the respective said flap portion via a fold-line, each said tab means having length slightly less than the width of said exterior hollow volume for reception and retention in the respective said exterior hollow volume, for retaining the respective said flap-portion in its downwardly-engaging state for closing off the open top of the respective said first and second end-section.

9. The commode according to claim 6, wherein each said flap-portion has a width less than the Width of said hollow interior of said central section, whereby each said flap-portion may be rotated downwardly into said hollow-interior volume of said central section for storage therein in the folded-in, collapsed state of the commode.

10. The commode according to claim 1, wherein the height of each of said central section and said first and second end-sections are approximately the same; each of said front and rear walls of said first and second end-sections and said central section comprising at least one vertical fold-line for folding-up the respective said section; said sections being made from one piece of cardboard.

11. The commode according to claim 1, in combination with a waste-receptacle bag for insertion into said hollow interior volume of said central section; said bag comprising a main receiving portion inserted in said hollow interior volume of said central section, and an upper rim portion for draping over said first and second end-sections for sanitary protection thereby and for retaining said bag in place during the process of using the commode.

12. A portable toilet comprising:

a waste-receptacle section having first and second side walls and a hollow interior volume in which is deposited waste products during the process of solid-waste elimination;

a first and a second seat-section connected on opposite sides to said first and second side walls of said waste-receptacle section and extending laterally outwardly therefrom so that said waste-receptacle section is flanked on both lateral sides thereof by said first and second seat-sections, said first and second seat-sections supporting thereon, a person seating thereon during the process of waste-elimination into said hollow interior of said waste-receptacle section;

each of said waste-receptacle section and said first and second seat-sections being made of cardboard, and wherein each said section comprises a plurality of fold-lines for folding up and collapsing during nonuse and storage thereof.

13. The portable toilet according to claim 12, wherein each of said sections comprises an open top; each of said first and second seat-sections comprising means for closing off the open top thereof; each said means for closing off comprising a pivotal flap portion having a first longitudinal edge surface connected to a side of said waste-receptacle section for pivotal rotation relative thereto, and a second longitudinal edge surface spaced from said first longitudinal edge surface, each said flap portion being pivotal toward and away the respective said open top of a respective said seat-section for alternatively closing off or exposing the open top thereof for erecting and collapsing the sections, respectively.

14. The portable toilet according to claim 13, wherein each of said first and second seat-sections defines a hollow interior volume, and comprises a stiffening member therein dividing said interior chamber into a laterally inward portion and a laterally outward portion; each said flap portion comprising tab means for insertion into a respective said laterally outward portion for retaining said flap portion in its downwardly-pivoted position where it closes off the top of the respective said seat-section.

15. The portable toilet according to claim 14, wherein the lateral Width of each flap-portion is less than the lateral width of said waste-receptacle section, whereby each said flap-portion may be pivoted downwardly into the hollow interior volume of said waste-receptacle portion for storage therein during the collapsed state of said sections.

16. The portable toilet according to claim 14, in combination with a waste-receptacle bag for insertion into said hollow interior volume of said waste-receptacle section; said bag comprising a main receiving portion inserted in the hollow interior volume of said waste-receptacle section, and an upper rim portion for draping over said first and second seat-sections for sanitary protection thereby and for retaining said bag in place during the process of using the commode, said bag also having an interior adhesive strip for use in sealing the upper mouth of the bag after using the commode.

17. A method of using a portable, collapsible toilet, which toilet comprises a collapsible, central, waste-receiving portion and a pair of collapsible, laterally-positioned seat-portions spaced on either lateral side of the central portion, each portion having an open top, said method comprising:

(a) unfolding the toilet by unfolding each of the portions thereof along appropriately placed fold-lines, such that the two seat-portions are positioned on the sides of the central portion;

(b) closing off the open tops of the pair of seat-portions with a flat sheet for providing seat-supporting surfaces that are spaced apart and divided by the hollow interior of the central portion;

(c) sitting on the seat-portions after said step (b), and using the hollow interior volume of the central portion for depositing waste material;

(d) collapsing the three portions after said step (c) by folding up along the fold-lines.

18. The method according to claim 17, further comprising:

(e) inserting a bag into the hollow interior volume of the central portion before said step (c), so that the bag will catch the waste products deposited during said step (c); and (f) disposing of the bag after said step (c);

said step (b) comprising pivoting downwardly a pair of flap-portions connected on either lateral side of the central portion until each flap-portion is substantially horizontally positioned on top of a respective seat-portion; and releasably retaining the flap-portions in their horizontal positions closing off the seat-portions.

19. The portable commode according to claim 18, wherein said central section and said supporting end-sections are one integral unit made of cardboard.

* * * * *